US006179202B1

(12) United States Patent
Alexander et al.

(10) Patent No.: US 6,179,202 B1
(45) Date of Patent: Jan. 30, 2001

(54) SINGLE SIDE IMAGED SPECIAL SERVICES MAILER

(75) Inventors: Joe A. Alexander, Angola, IN (US); Joseph V. Deaner, Forest Hill; L. Michael McKee, Middletown, both of MD (US)

(73) Assignee: Moore North America, Inc., Grand Island, NY (US)

( * ) Notice: Under 35 U.S.C. 154(b), the term of this patent shall be extended for 0 days.

(21) Appl. No.: 09/366,200

(22) Filed: Aug. 4, 1999

(51) Int. Cl.[7] ..... B42D 15/00

(52) U.S. Cl. ..... 229/92.8; 229/300; 283/81

(58) Field of Search ..... 229/300, 92.8, 229/70, 74; 283/81

(56) References Cited

U.S. PATENT DOCUMENTS

| | | | | |
|---|---|---|---|---|
| 1,568,880 | | 1/1926 | Conklin . | |
| 2,229,223 | | 1/1941 | Rhodes . | |
| 3,937,492 | | 2/1976 | Biron . | |
| 3,968,927 | | 7/1976 | Katz et al. . | |
| 4,682,793 | | 7/1987 | Walz . | |
| 4,809,905 | | 3/1989 | Goodman . | |
| 5,071,167 | | 12/1991 | O'Brien . | |
| 5,183,203 | | 2/1993 | Sanders . | |
| 5,190,210 | | 3/1993 | Walz . | |
| 5,267,898 | | 12/1993 | Doll et al. . | |
| 5,383,686 | | 1/1995 | Laurash . | |
| 5,397,052 | | 3/1995 | Walz . | |
| 5,413,383 | * | 5/1995 | Laurash et al. | 229/300 X |
| 5,476,420 | | 12/1995 | Manning . | |
| 5,501,393 | | 3/1996 | Walz . | |
| 5,547,227 | | 8/1996 | Laurash et al. . | |
| 5,573,277 | | 11/1996 | Petkovsek . | |
| 5,626,286 | | 5/1997 | Petkovsek . | |
| 5,626,370 | * | 5/1997 | Petkovsek | 229/300 X |
| 5,664,725 | | 9/1997 | Walz . | |
| 5,697,648 | | 12/1997 | Petkovsek . | |
| 5,746,450 | | 5/1998 | Petkovsek . | |
| 5,836,622 | | 11/1998 | Fabel . | |
| 5,848,809 | | 12/1998 | Petkovsek . | |
| 5,860,904 | | 1/1999 | Petkovsek . | |
| 5,899,504 | | 5/1999 | Fabel . | |
| 5,951,053 | * | 9/1999 | Petkovsek | 283/81 |
| 6,003,902 | * | 12/1999 | Petkovsek | 229/300 X |

* cited by examiner

*Primary Examiner*—Jes F. Pascua
(74) *Attorney, Agent, or Firm*—Nixon & Vanderhye PC

(57) ABSTRACT

A special service mail form constructed of a sheet of paper and a backing sheet adapted to simplex printing so as to allow use of the special service mail form is a self-help, kiosk. The sheet of paper is divided into two sections by a line of weakness. The first section provides a return post card having printed indicia on the front surface associated with special service mailers such as PS Form 3811. The second section includes two adhesive backed removable labels. Return address information is printed onto one of these two labels. To assemble a special services mailer, the return address label is removed from the remainder of the sheet of paper and applied to the appropriate area on the back of the return post card. The backing sheet is attached to a back surface of the sheet of paper to protect the adhesive applied to the back of the labels from exposure prior to their detachment from the remainder of the sheet of paper.

4 Claims, 5 Drawing Sheets

Fig. 3A
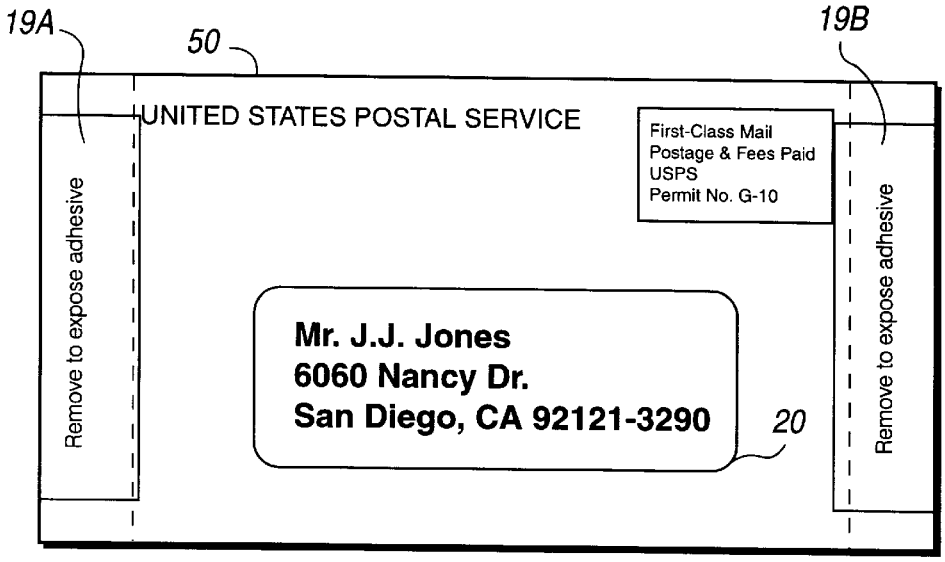
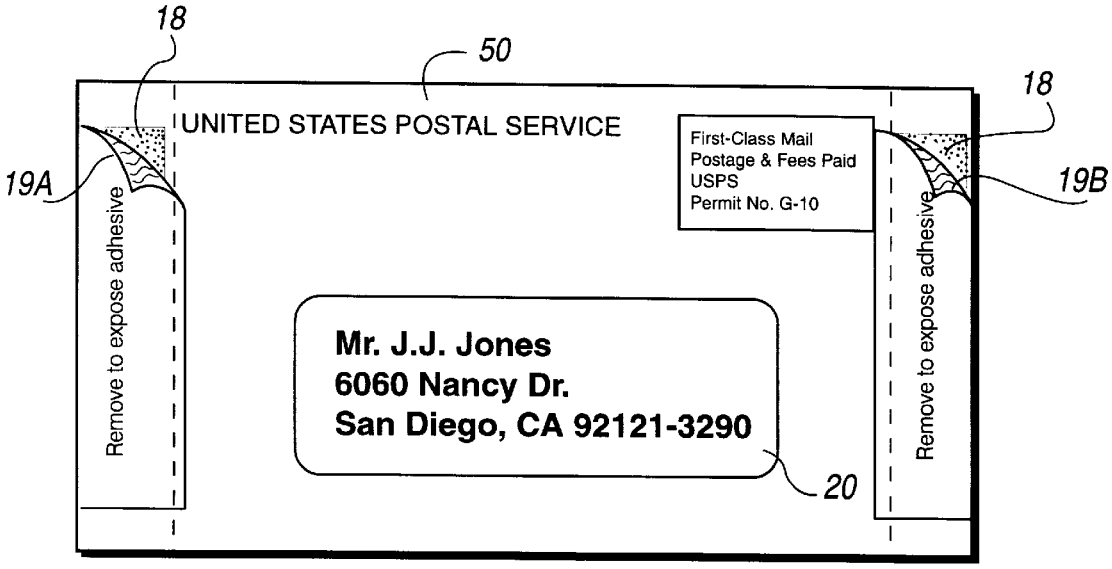
Fig. 3B

SINGLE SIDE IMAGED SPECIAL SERVICES MAILER

BACKGROUND AND SUMMARY OF THE INVENTION

There is a continuing need for a readily available, easy to use specialty type of certified mailer type business form that provides all of the Post Office approved components necessary to complete a certified mailing in a self-help, kiosk-style, environment. The forms components necessary to complete a certified mailing vary according to circumstance and individual preference, but to include all components the form should include, at a minimum: a Domestic Return Receipt post card (PS form 3811), a certified mail label, and a proof of mailing receipt. While several certified mailer forms providing these components are available, those forms are either standard forms available from the Post Office (which must be filled out by hand or typed), or custom forms which require pre-printing return addresses on the return post card, multiple passes through a printer, or complex post-printing assembly.

One of the known certified mail forms is disclosed in U.S. Pat. No. 5,501,393 to Walz. The Walz '393 patent shows a multi-part mailing form suitable for use in a certified mail application. That form, however, is constructed of two superimposed sheets bonded with by a adhesive/release agent combination. Moreover, the return post card provided by the Walz '393 construction must either have the return address pre-printed on the back side of the form, or be run through the printer twice (called a duplex printing operation). U.S. Pat. No. 5,190,210 to Walz discloses another type of special service mail form, but like the form of the '393 patent, this form also requires duplex printing or pre-printing of return address information on the back side of the form. Given the two-sided nature of these forms, neither is well suited to the self-service kiosk environment.

Although not particularly directed to the self-serve, kiosk environment, U.S. Pat. No. 5,836,622 to Fabel discloses a single sided special service mail form. Like the Walz '393 form, this Fabel '622 utilizes the superimposed sheet construction. The Fabel '622 form differs from the Walz '393 construction in that it utilizes a fold over construction. Specifically, once the Fabel '622 form is printed, the a portion of the top sheet is removed and folded about a pre-disposed fold line to create the return post card receipt. Given the instantaneous bonding that occurs when the adhesive comes into contact during folding, misalignment can render the Fabel '622 form unusable. Thus, the Fabel '622 patent teaches the use of a pre-formed fold line in combination with an gap in the adhesive around the fold line to reduce the risk of waste caused by misalignment. This adhesive gap, however, degrades the quality of the post card ultimately formed as the front and back plies of the card thus created do not adhere in the area immediately adjacent the fold line.

It is therefore the primary object of the present invention to provide a simple but effective certified mailer type business form which can be printed in a self-serve kiosk that avoids the need for pre-printing return address information without requiring multiple passes through a printer or complex post-printing assembly. It is also an object of the present inventions to provide an improved multiple function certified mail form which is inexpensive to manufacture.

In accordance with one aspect of the present invention, a special service mail form is provided which comprises a sheet of paper having front and back surfaces, a first line of weakness dividing said sheet of paper into a first and second section, said first section including a detachable return post card having printed indicia on the front surface of the sheet, an area to receive a return address label on the back surface of the sheet, second and third lines of weakness defining tear off margin areas on said return post card, adhesive applied to the back surface of the sheet in the post card tear off margin areas, and removable backing sheets applied to adhesive applied to the back surface of the sheet in the post card tear off margin areas, the second section of said sheet of paper having at least two detachable labels which are detachable from remainder of said second section, each of said detachable labels having an adhesive backing, a backing sheet having a front surface coated with a release agent, said front surface of said backing sheet being removably secured to said adhesive backing applied to select portions of said sheet of paper.

In a further embodiment of the present invention, the special service mail form further includes an additional line of weakness defining a detachable mailer receipt suitable for use as a Post Office proof of mailing receipt.

Other objects and advantages of the invention will be apparent from the following description, the accompanying drawings, and the appended claims.

BRIEF DESCRIPTION OF THE DRAWINGS

FIG. 3A is an illustration of the back face of the return receipt post card removed from the form depicted in FIGS. 1 and 2, detached from that form along the line marked III—III;

FIG. 3B is a partial perspective view of the back face of the return receipt post card removed from the mail form depicted in FIGS. 1 and 2, detached from the form along the line marked III—III;

DETAILED DESCRIPTION OF THE DRAWINGS

Figure 1:
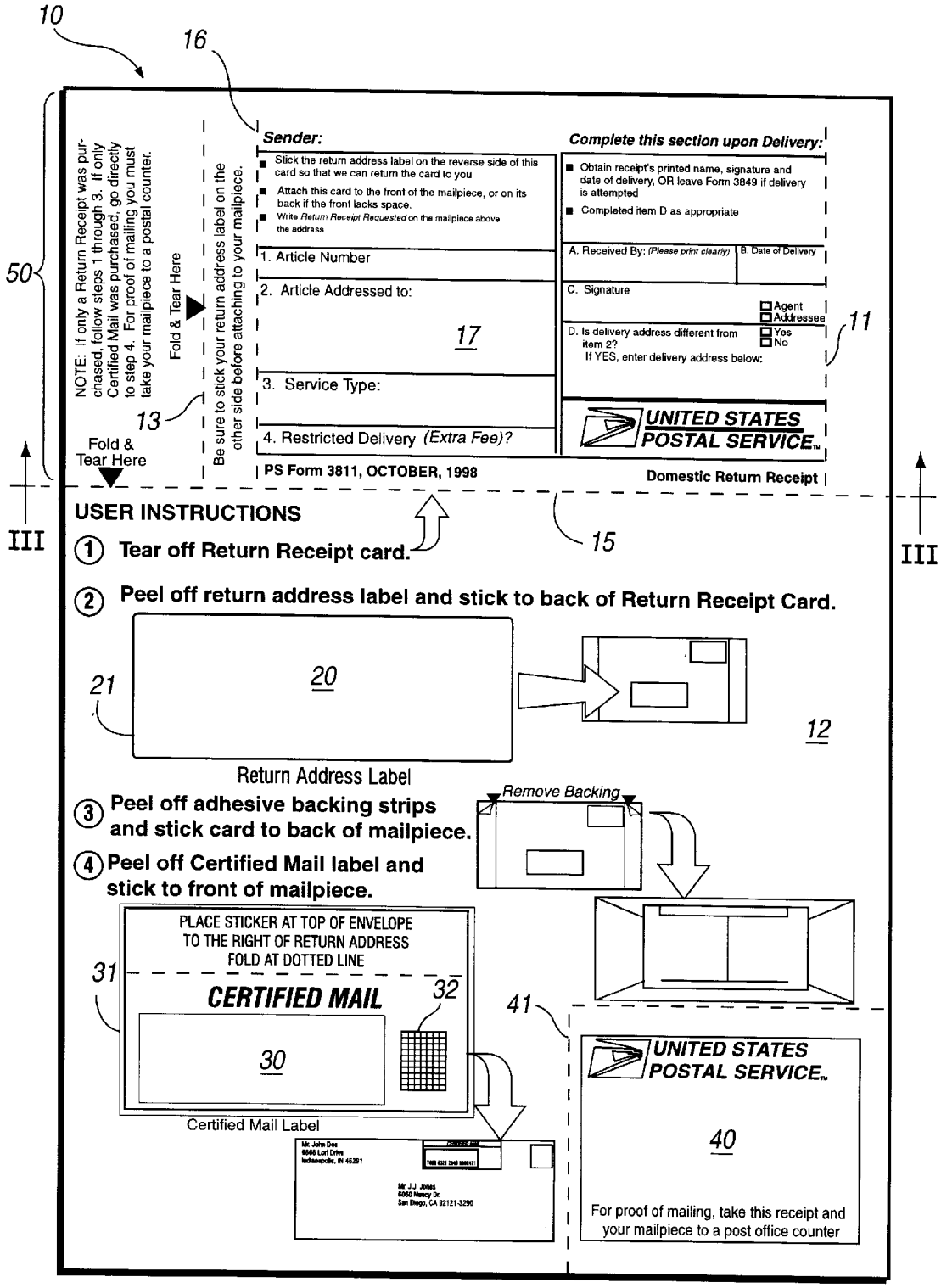
FIG. 1 is a top plan view of the front face of an exemplary certified mail form according to the present invention.

The form of the present invention is designed for use in a self-service kiosk (not shown). An exemplary certified mail form according to the present invention is shown generally by reference numeral 10 in FIGS. 1 and 2. The intermediate 10 preferably comprises a single sheet of paper 12 (which may have a weight up to that commonly known as 100 # tag stock or paperboard). To conform with postal requirements and to minimize jamming of the Post Office mail handling equipment, the paper stock used to construct the exemplary certified mail form of the present invention is at least 7 mils, and preferably 9 mils, thick.

As best illustrated in FIG. 1, The form 10 of the preferred embodiment is comprised of four mail components. The first mail component is an index stock return post card receipt 17 (PS Form 3811). A line of weakness 15, formed by perforations which extend across the width of form 10, are position so as to allow ready separation of the return post card section 50 from the remainder of the form 10. The front face of this Form 3811 is pre-printed (without the address and identifier information specific to a mail item) and organized just like the Form 3811 provided by the Post Office. The return post card section 50 further includes vertical lines of weakness 11, 13, and 16. Like the horizontal line of weakness 15, each of these lines of weakness are formed by a series of perforations cut into form 10. Line of weakness 13 extends between the line of weakness 15 to the top of form 10 and allows for ready separation of the outgoing return post card receipt 17 from the remainder of the return post card section 50.

Figure 2:
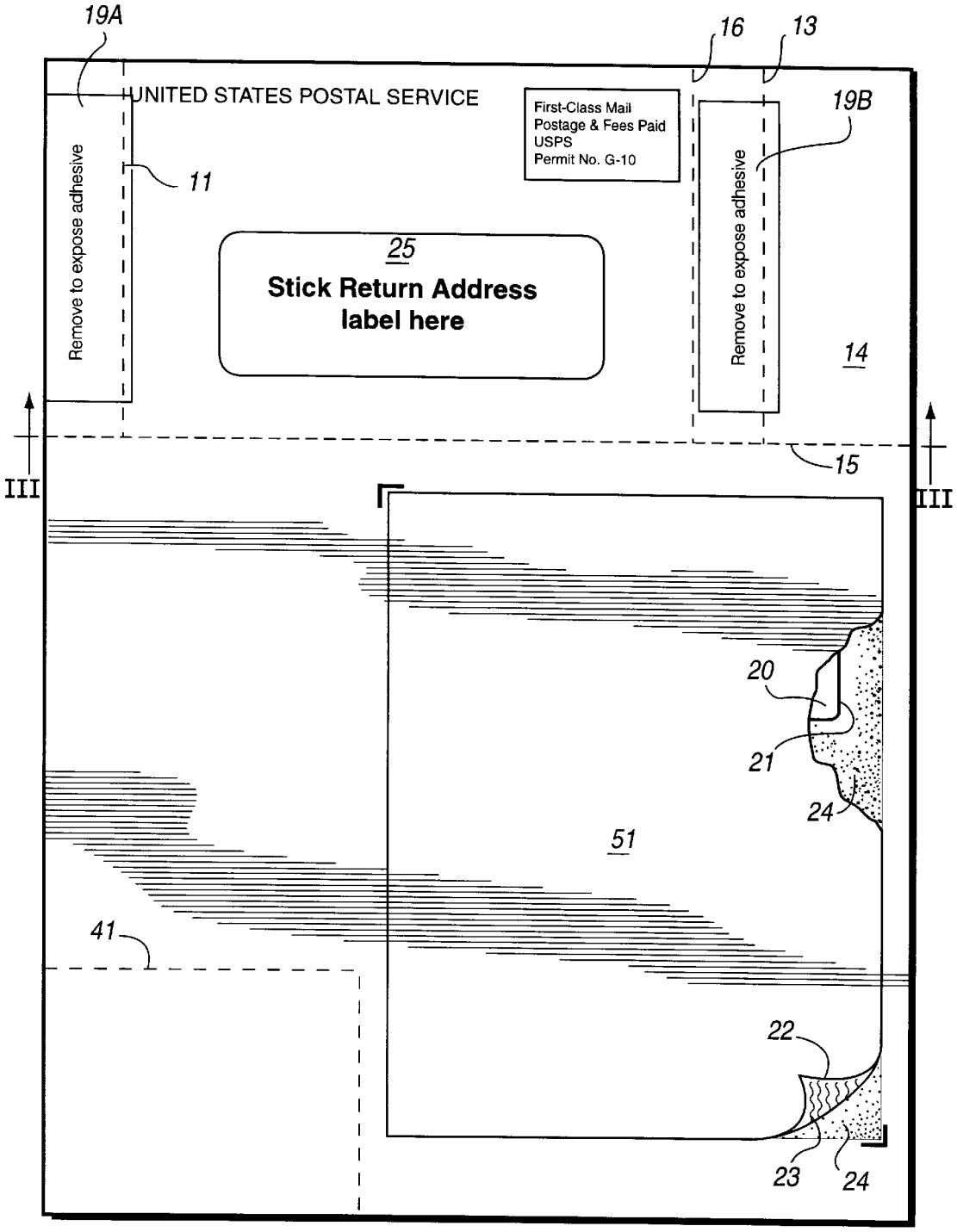
FIG. 2 is a top plan view of the back face of the mail form of FIG. 1.
Figure 3C:
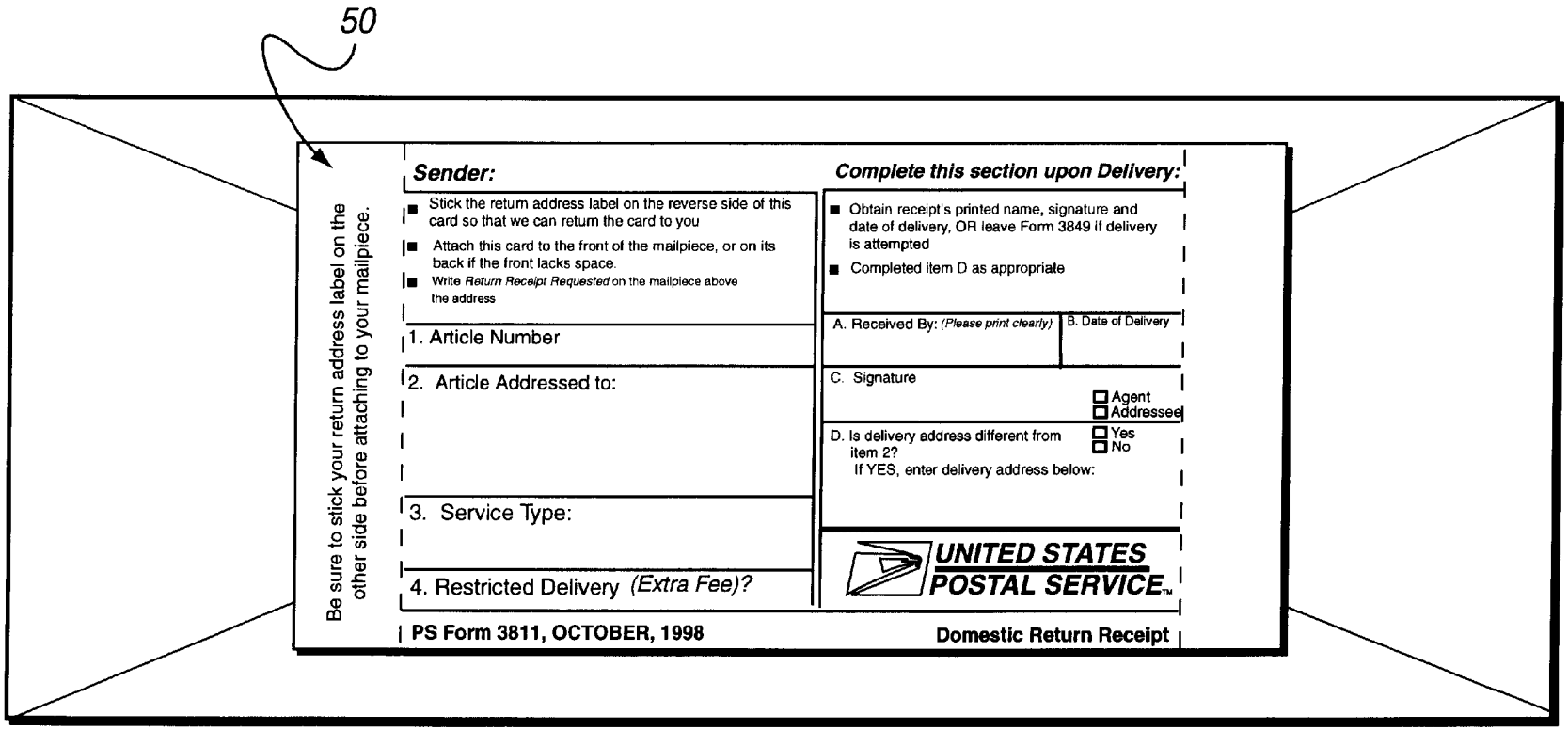
FIG. 3C is a plan view of the return receipt post card removed from the form depicted in FIGS. 1 and 2, attached to an outgoing mail piece.

FIG. 2 illustrates that the back face of the return receipt card 17 includes an area 25 designed to receive a printed return address label 25 (discussed below). FIG. 3A best illustrates the application of a sample return address label 20 on the back side of the return receipt card 17. The back surface of the return post card 17 is provided with strips of adhesive 18 and tear-off paper strips, or backing strips, 19A and 19B which, when removed, expose adhesive 18 (shown in FIG. 3B) used to secure the return post card 17 to a mail piece (as illustrated in FIG. 3C).

The second mail component of form 10 consists of an adhesive backed, removable return address label 20. The return address label 20 is formed by die cutting the form 10 during the manufacturing process. Die cut 21, illustrated in FIGURE and the cutaway in FIG. 2, enables the postal customer t simply peel off the return address label 20 after it has been printed. The print area of label 20 is found on the front surface of form 10 so as to enable all addressing information, outgoing as well as return, to be printed on the front surface 12 of the form. This design structure eliminates the need to pre-print the return address on the return receipt card 17 (which cannot be readily accomplished in the self-service kiosk environment) or to run the form through a printer twice, printing address information on both sides of the form (which also creates handling problems in the kiosk environment).

The third section of form 10 consists of an adhesive-backed, removable certified mail label 30. This certified mail label 30 is designed to accept a printed certified mail tracking number (identifier). Because the print area of the certified mail label is provided on the front face 12 of form 10, a tracking number can be printed at the same time that other mailing information is printed on form 10. in the preferred embodiment, the certified mail label 30 is sized such that the top portion of the label can be folded over the top edge of an outgoing mail piece (as depicted in the printed instructions on the form 10 in FIG. 1). The certified mail label 30 includes the so-called "Taggant" ink security feature 32 required by Postal Regulations.

The fourth mail component of form 10 comprises a detachable portion which can be used to print mailing cost information and then taken to the post office counter to obtain proof of mailing. This detachable portion serves as a proof of mailing receipt 40. As shown best in FIG. 1, the proof of mailing receipt 40 is readily separated from the remainder of form 10 by the line of weakness 41. Line of weakness 41 is formed by a series of perforations surrounding the proof of mailing receipt 40.

Figure 4:
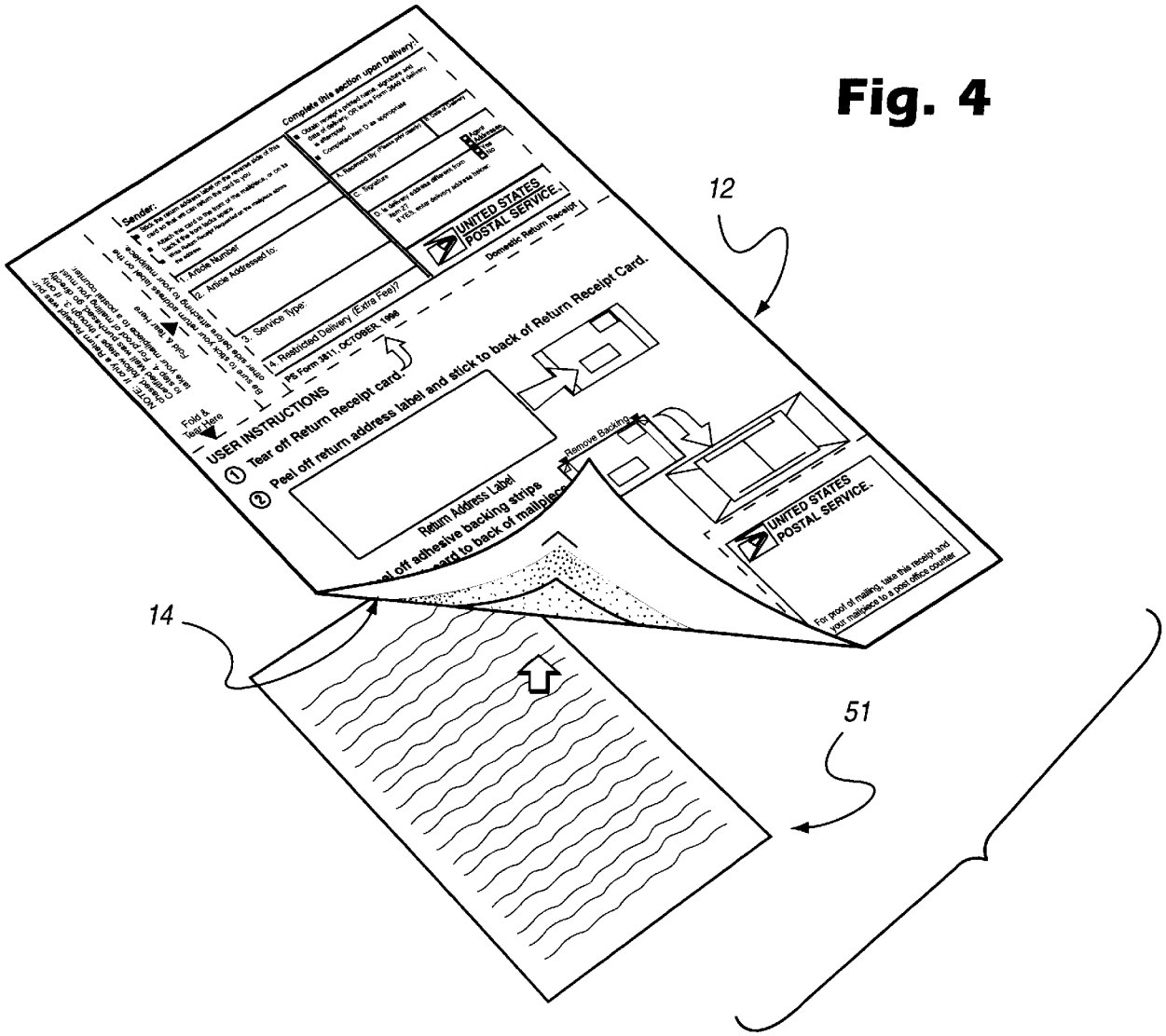
FIG. 4 is an exploded view of the exemplary certified mail form according to the present invention.

As best shown in FIGS. 2 and 4, the preferred embodiment of form 10 includes an adhesive coating 24 on select portions of the back surface 14. Specifically, this adhesive coating 24 is positioned on at least the back surfaces of labels 20 and 30. A backing material or sheet 51 is positioned so as to cover the pattern of adhesive 24 provided on the back surface 14 of form 10. The liner or backing sheet 51 is treated with a release material 23 that permits removal of the adhesively-backed labels 20 and 30 from the form and subsequent attachment to a mail item or the back surface of the return receipt card 17. The release material 23 of the preferred embodiment is silicone. This same release material can also be used with the removable backing strips 19A and 19B which cover the adhesive 18 applied to the back surface 14 of the return post card receipt 17.

To utilize the exemplary certified mail form of the present invention, the form 10 is fed into a printing device (not shown), that printing device is pre-programmed to print the inputted delivery information, including addressee and sender addresses information and other mailing information onto selected areas of the front face 12 of form 10. More specifically, The "Article Number" information is printed into the appropriate area of the Domestic Return Receipt Card 17 (in the area designated on form 17 as "box 1") and the "Certified Mail Label" 30. The addressee's address information is printed in "box 2" of the Domestic Return Receipt Card 17. The Service selected (i.e., certified mail, return receipt requested) is printed in "box 3" of the Domestic Return Receipt Card 17, and the sender's return address is printed on "Return Address Label" 20. Other relevant mailing information, such as the information found on a proof of mailing receipt is printed in the appropriate area of the form such as on the receipt area 40 provided with the certified mail form 10.

To use the printed certified mail form 10, the postal customer first separates the Return Receipt Card 50 from the remainder of the form 10 by tearing at the line of weakness formed by perforations 15. To facilitate this tearing, the postal customer may first chose to fold the form 10 at the line of weakness form by perforations 15. Thereafter, the postal customer peels the return address label 20 from the remainder of the form 10 so as to expose the adhesive 24 on the back surface of the label 20. The address label 20 is then placed on back surface 14 of the Return Receipt Card 50 in the return address area 25. Application of the return address label 20 prepares the Return Receipt Card 50 for attachment to an out going mail piece 51 for shipment.

To use the mail form thus prepared, the postal customer peels off the backing strips 19A and 19B from the back of the Return Receipt Card 50 and uses the adhesive 18 exposed by removal of the backing strips 19A and 19B to affix the Return Receipt Card 50 to the mail item. The placement of the Return Receipt Card 50 to the mail item 51 is best illustrated by FIG. 3C. The exposure of the adhesive strips 18 on the back of card 50 by the removal of the backing strips 19A and 19B is shown if FIG. 3B.

The postal customer then peels the certified mail label 30 from the remainder of the form to expose the adhesive 24. This adhesive 24 is then used to affix the certified mail label to the outgoing mail piece 51. Although the certified mail label 30 depicted as the preferred embodiment of the mail form 10 is shown as having a fold line which can be used to guide application of the certified mail label 30 at the top edge of an outgoing envelop so as to fold over the top of the envelop, this fold line is purely optional. Moreover, the certified mail label 30 can be placed at anywhere on the outgoing mail piece 51. The certified mail label 30 must, however, be placed at a visible location on the outgoing mail piece. Having applied the certified mail label 30, the outgoing mail piece is ready for mailing. The final step is to detach the mailing receipt 40 from the remainder of the form by tearing at the line of weakness 41 (defined by perforations) and taking that receipt, with the outgoing mail piece to the Post Office counter.

Upon delivery of the mail piece 51 to the designated address (or person if restricted delivery is requested), the postal carrier obtains a signature from the recipient acknowledging receipt of the mail piece 51, and the postal carrier tears the return post card 50 at the lines of weakness 11 and 13 (formed by perforations) and removes the return receipt card 50 from the mail piece 51. The anchor portions of the return receipt card 50 remain with the mail piece 51 by virtue of the adhesive backing 18. The return receipt card 50 is then returned to the postal customer to establish the receipt of the mail item by the intended recipient.

As the above description makes clear, the mail form of the present inventions is uniquely adapted to work in the self-service Kiosk environment. The provision of the adhesive-backed return address label allows a kiosk printer to print all of the required information on one side of the form. Thus, duplex printing (where the form is run through a printer twice) is not required and the mail forms do not require the pre-printing of return address information.

The postal customer simply enters the appropriate addressing information and mail service selection into the a word processor installed in the kiosk, and instructs that computer to print. While the form of the present invention is ideally suited for use with a laser printer, the form is not limited to use with laser printers and an impact printer can be readily substituted for a laser printer. The printed form is then dispensed by the kiosk printer to the postal customer. The form of the present invention allows the postal customer to quickly obtain typed or printed labels and mail components for ready attachment to a mail piece. The professional appearance of the mail form components thus provided is improved by the fact that none of those components used bear handwritten entries.

While the invention has been herein shown and described in what is presently conceived to be the most practical and preferred embodiment thereof, it will be apparent to those skilled in the art that many modifications may be made thereof within the scope of the invention, which scope is to be accorded the broadest interpretation of the appended claims so as to encompass all equivalent structures and devices.

What is claimed is:

1. A special service mail form comprising:

a sheet of single-ply paper having front and back surfaces;

a first line of weakness dividing said sheet of paper into first and second sections said first section including a detachable return post card having printed indicia on the front surface of the sheet, an area to receive a return address label on the back surface of the sheet, second and third lines of weakness defining tear off margin areas on said return post card, adhesive backing applied to the back surface of the sheet in the post card tear off margin areas, and removable backing sheets applied to adhesive applied to the back surface of the sheet in the post card tear off margin areas;

the second section of said sheet of paper having at least two detachable labels which are detachable from a remainder of said second section, each of said detachable labels having an adhesive backing, one of said detachable labels being adapted to receive return address indicia and being sized for being attached to said return address area on the back surface of the return postcard;

a backing sheet having a front surface coated with a release agent, said front surface of said backing sheet being removably secured to said adhesive backing applied to select portions of said second section of said sheet of paper.

2. A special service mail form as recited in claim 1 in which the form is constructed of 100 # paper stock.

3. A special service mail form as recited in claim 1 wherein said adhesive is pressure sensitive.

4. A special service mail form as recited in claim 1 wherein said sheet further includes an additional line of weakness defining a detachable mailer receipt.

* * * * *